US008756961B2

(12) United States Patent
Qiu et al.

(10) Patent No.: US 8,756,961 B2
(45) Date of Patent: Jun. 24, 2014

(54) DOOR ASSEMBLY AND CASING HAVING THE SAME

(75) Inventors: Hai-Nan Qiu, New Taipei (TW); Fu-Lung Lu, New Taipei (TW)

(73) Assignee: Wistron Corporation, New Taipei (TW)

( * ) Notice: Subject to any disclaimer, the term of this patent is extended or adjusted under 35 U.S.C. 154(b) by 217 days.

(21) Appl. No.: 13/470,214

(22) Filed: May 11, 2012

(65) Prior Publication Data

US 2012/0293055 A1 Nov. 22, 2012

(30) Foreign Application Priority Data

May 16, 2011 (CN) ..... 2011 1 0125448

(51) Int. Cl.
*E05B 65/44* (2006.01)

(52) U.S. Cl.
USPC ..... 70/79; 70/78; 70/81; 312/218; 292/119; 292/129; 292/DIG. 18

(58) Field of Classification Search
USPC ..... 70/78, 79, 81, 82, 85; 312/218, 219, 312/107.5; 292/119, 129, 156, 157, DIG. 18
See application file for complete search history.

(56) References Cited

U.S. PATENT DOCUMENTS 2,518,141 A * 8/1950 Hiler ..... 70/79
2,740,284 A * 4/1956 Gray ..... 70/79
2,852,926 A * 9/1958 Chervenka ..... 70/79
3,040,555 A * 6/1962 Wartian ..... 70/97
3,087,749 A * 4/1963 Capton ..... 292/99
3,087,765 A * 4/1963 Chapman ..... 312/209
3,404,929 A * 10/1968 Wright et al. ..... 312/216
4,303,287 A * 12/1981 Taplin ..... 312/215
4,865,404 A * 9/1989 Harper ..... 312/221
4,957,334 A * 9/1990 Lakso ..... 312/221
5,209,168 A * 5/1993 Chapron et al. ..... 109/59 T
5,219,191 A * 6/1993 Wolter ..... 292/157
5,802,891 A * 9/1998 Kahara et al. ..... 70/79
5,862,689 A * 1/1999 Wen ..... 70/85
6,722,167 B1 * 4/2004 Hsu ..... 70/78
7,946,663 B2 * 5/2011 Holcomb ..... 312/218
2003/0102784 A1 * 6/2003 Friar et al. ..... 312/218
2004/0194517 A1 * 10/2004 Samsel ..... 70/78
2006/0066187 A1 * 3/2006 Chang ..... 312/219

* cited by examiner

*Primary Examiner* — Suzanne Barrett
(74) *Attorney, Agent, or Firm* — Brinks Gilson & Lione

(57) ABSTRACT

A door assembly includes a door base, a door disposed pivotally on the door base for covering openably the door base, and a locking mechanism. The locking mechanism includes a first body biased to move relative to the door base in a first direction, a first engaging portion disposed at the first body, a pushing portion disposed at the first body, a second body disposed at the door, and a second engaging portion disposed at the second body. A lock is operable to move the first body relative to the door base in a second direction opposite to the first direction. The first engaging portion is biased to move in the first direction to thereby engage the second engaging portion, so as to lock the door at a locked position for covering the door base.

28 Claims, 10 Drawing Sheets

DOOR ASSEMBLY AND CASING HAVING THE SAME

CROSS-REFERENCE TO RELATED APPLICATION

This application claims priority of Chinese Application No. 201110125448.2, filed on May 16, 2011, the disclosure of which is incorporated herein by reference.

BACKGROUND OF THE INVENTION

1. Field of the Invention

This invention relates to a door assembly and a casing, and more particularly to a door capable of being automatically pushed open when unlocked, and a casing having the door.

2. Description of the Related Art

A conventional electronic casing has a casing body and a door that is controlled through operation of a lock to lock or unlock relative to the casing body. When unlocked, the door can be pivoted manually away from the casing body. However, any movement of the door does not occur while the door is being unlocked. That is, the user cannot realize the unlocking of the door from the outer appearance of the electronic casing. As such, if the user wants to know whether the door is unlocked or not, he or she must try to push open the door, thereby resulting in inconvenience during use of the conventional electronic casing.

Moreover, when a force for rotating a key in the lock to unlock the door is released, the lock cannot return to its original position. Hence, the user must rotate frequently the key to convert the door between locked and unlocked states, thereby further resulting in inconvenience during use of the conventional electronic casing.

SUMMARY OF THE INVENTION

An object of this invention is to provide a door that can be automatically pushed open when unlocked, and a casing having the door.

Another object of this invention is to provide a door having a lock capable of returning automatically to its original position when a force applied thereto for unlocking the door is released, and a casing having the same.

According to this invention, a door assembly includes a door base, a door, and a locking mechanism. The door is disposed pivotally on the door base for covering openably the door base. The locking mechanism includes a first locking member, a second locking member, and a lock. The first locking member includes a first body disposed movably on the door base and biased to move relative to the door base in a first direction, a first engaging portion disposed at the first body, and a pushing portion disposed at the first body. The second locking member includes a second body disposed at the door, and a second engaging portion disposed at the second body. The lock is disposed on the door base, and is operable to move the first body relative to the door base in a second direction opposite to the first direction. The first engaging portion is biased to move in the first direction to thereby engage the second engaging portion, so as to lock the door at a locked position for covering the door base. When the lock is operated to move the first body in the second direction, the first engaging portion is removed from the second engaging portion, and the second body is pushed by the pushing portion to separate from the door base.

BRIEF DESCRIPTION OF THE DRAWINGS

These and other features and advantages of this invention will become apparent in the following detailed description of an embodiment of this invention, with reference to the accompanying drawings, in which.

DETAILED DESCRIPTION OF THE PREFERRED EMBODIMENT

Figure 1:
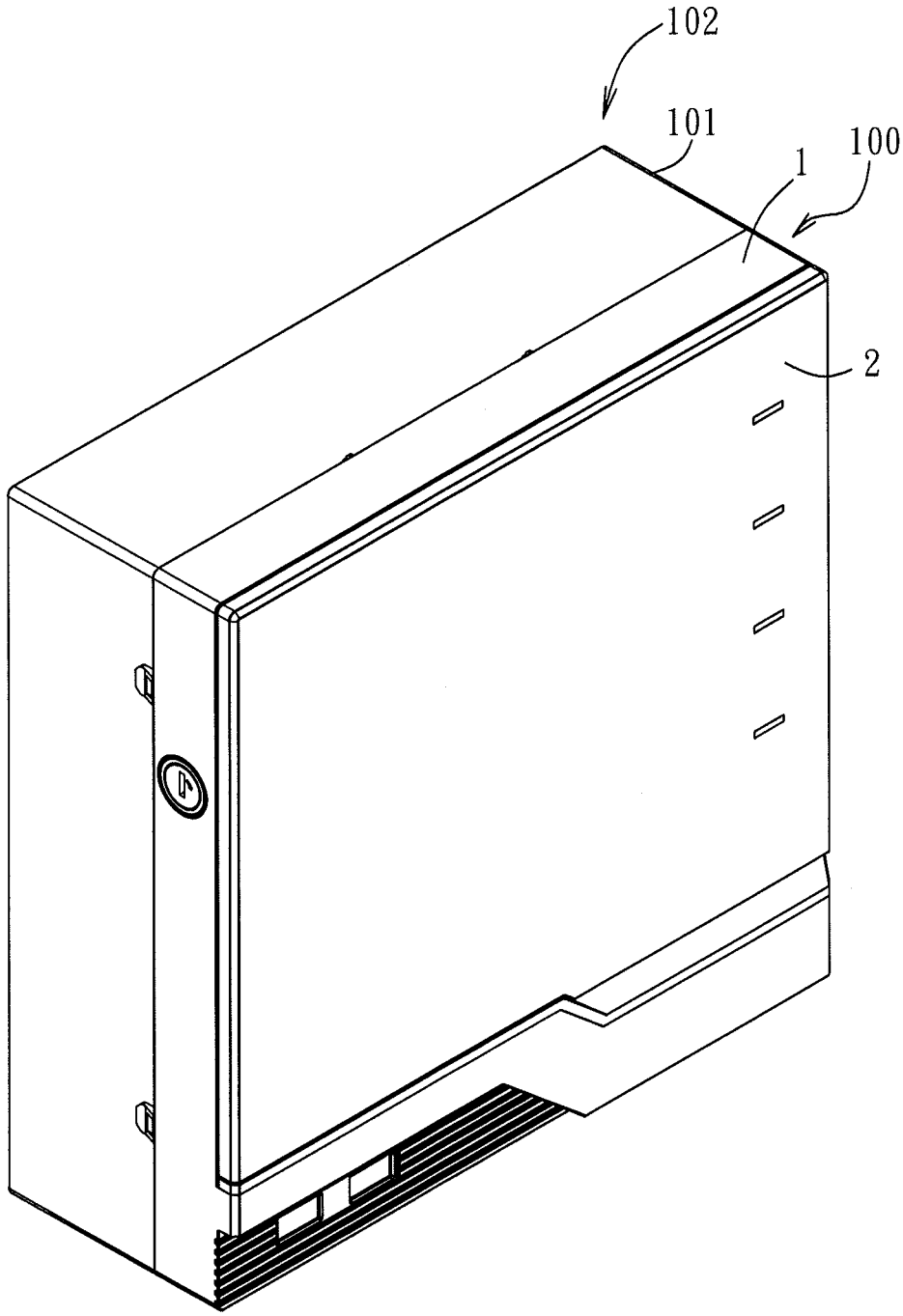
FIG. 1 is a perspective view of an electronic casing including the embodiment of a door assembly according to this invention.
Figure 2:
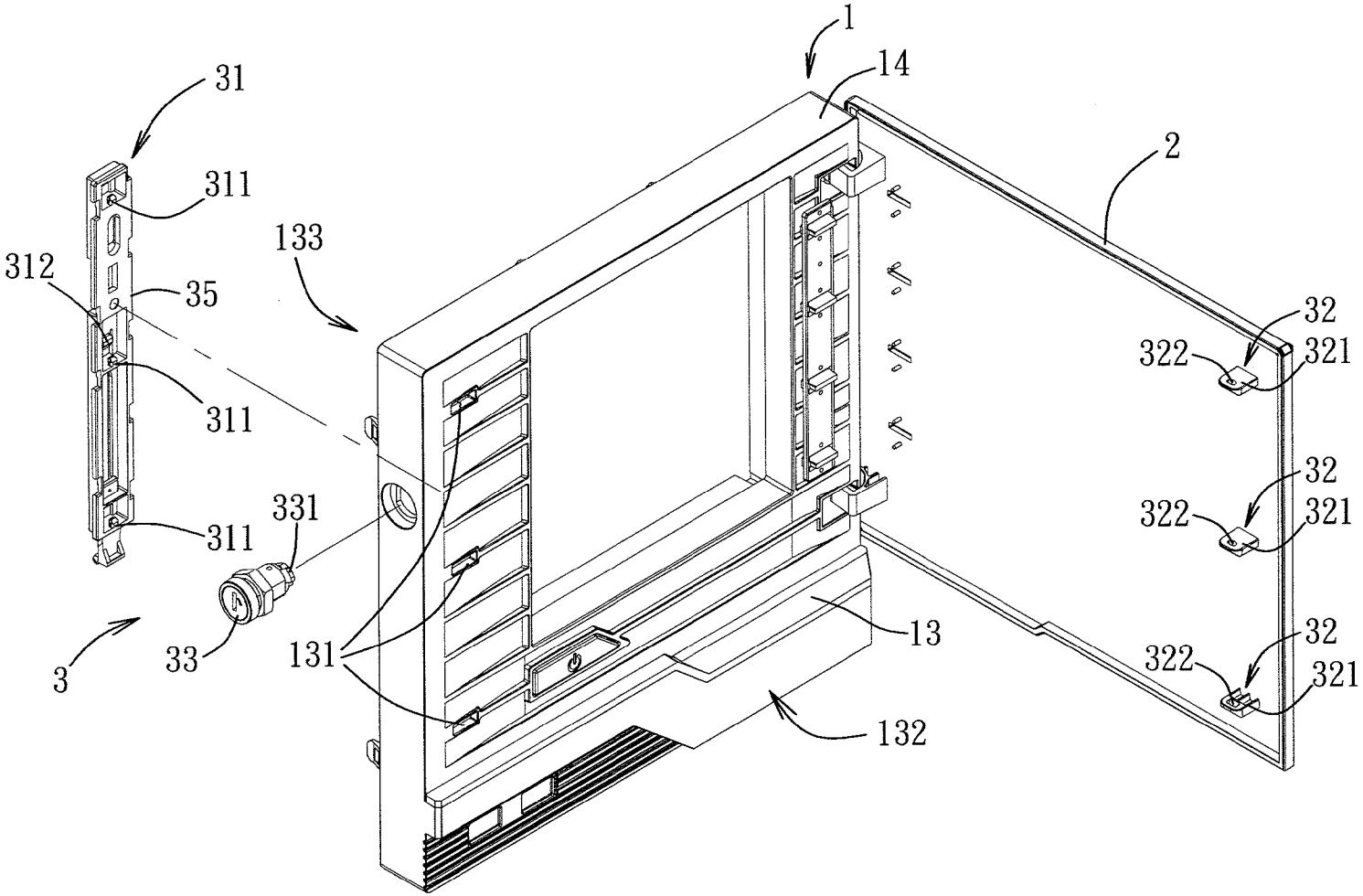
FIG. 2 is a partly exploded front perspective view of the embodiment.

Referring to FIGS. 1 and 2, the embodiment of a door assembly 100 according to this invention is mounted to a housing 101 to form an electronic device or electronic casing 102. The door assembly 100 includes a door base 1 connected to the housing 101, a door 2, and a locking mechanism 3. The door 2 is disposed pivotally on the door base 1 for covering openably the door base 2.

Figure 3:
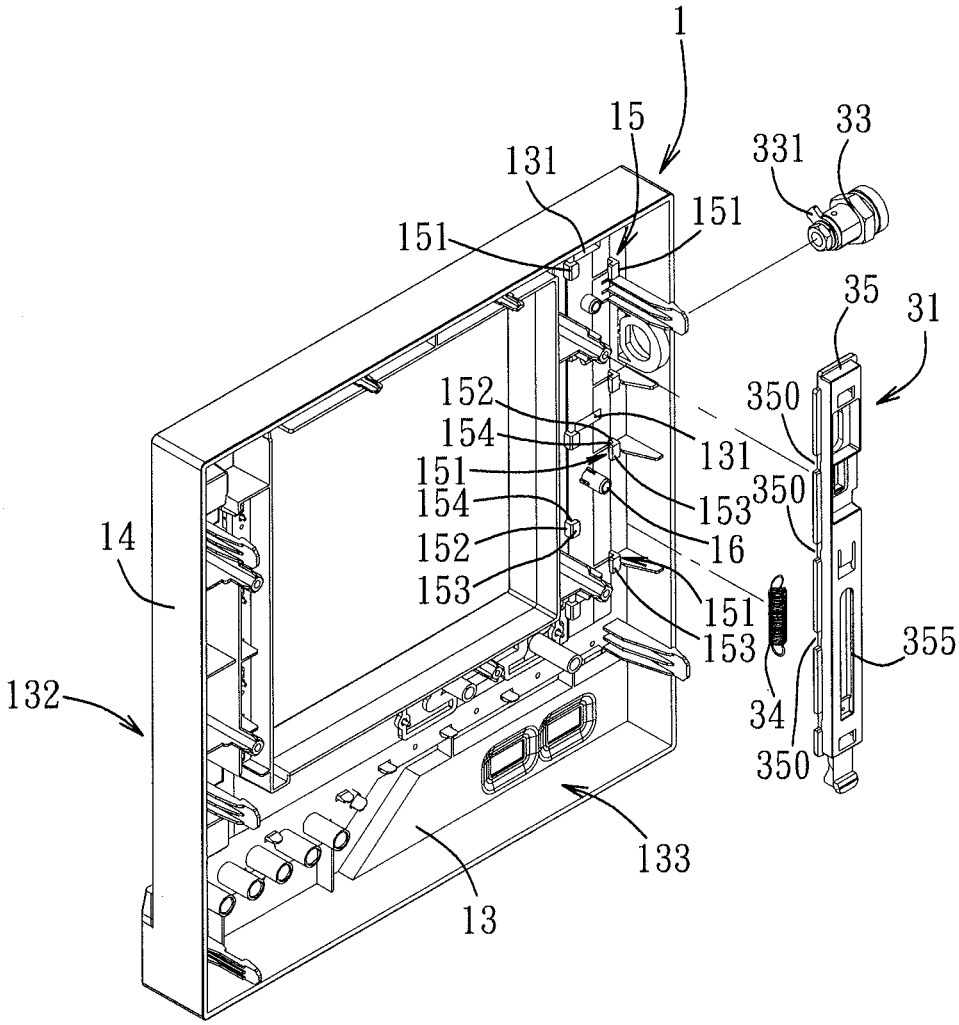
FIG. 3 is a partly exploded rear perspective view of the embodiment.

With further reference to FIG. 3, in this embodiment, the door base 1 includes a panel 13, a surrounding plate 14, and a guiding structure 15 disposed at the panel 13. The panel 13 has a plurality of holes 131 arranged one above another, a front surface 132, and a back surface 133. The surrounding plate 14 extends rearwardly from a periphery of the panel 13. The guiding structure 15 is disposed at the back surface 133 of the panel 13. In this embodiment, the guiding structure 15 includes a plurality of guiding blocks 151 disposed on the back surface 133 of the panel 13 and arranged in two vertical rows. Each of the guiding blocks 151 is L-shaped, and includes a first flat plate portion 152 extending rearwardly from the back surface 133 of the panel 13, and a second flat plate portion 153 extending perpendicularly from an end of the first plate portion 152 and spaced apart from the back surface 133 of the panel 13. As such, each of the guiding blocks 151 cooperates with the back surface 133 of the panel 13 to define a guiding groove 154 therebetween. The holes 131 are disposed between the two rows of the guiding blocks 151. Each of the holes 131 is disposed between two adjacent guiding blocks 151 in each row. The second flat plate portions 153 of each row of the guiding blocks 151 extend toward the other row of the guiding blocks 151.

Figure 4:
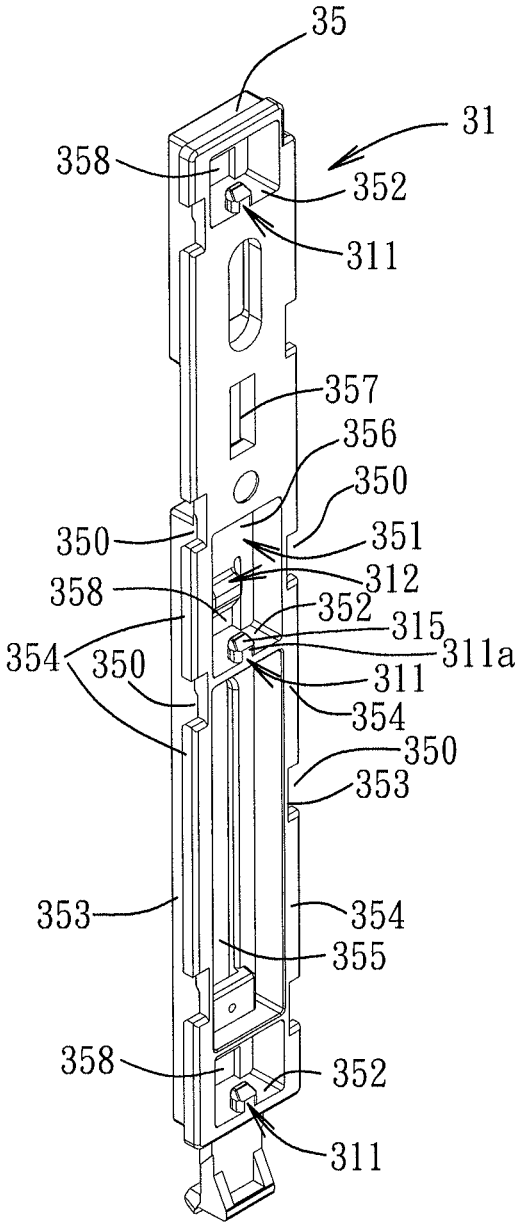
FIG. 4 is a perspective view of a first locking member of the embodiment.
Figure 5:
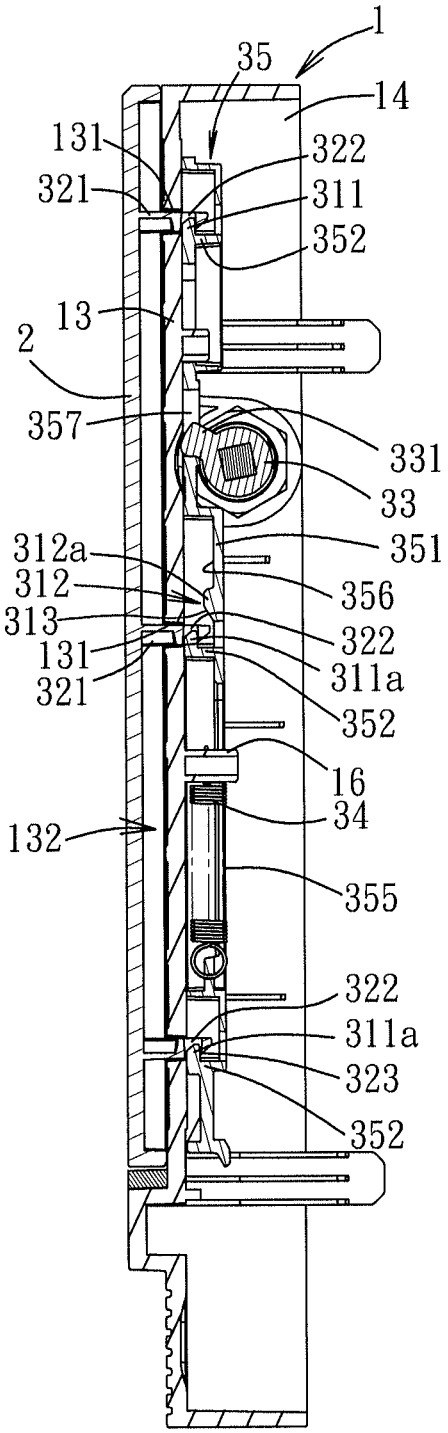
FIG. 5 is a sectional view of the embodiment, illustrating that a plurality of first engaging portions are engaged respectively within a plurality of second engaging portions.

With further reference to FIGS. 4 and 5, the locking mechanism 3 includes a first locking member 31, three second locking members 32, a lock 33, and a resilient member 34.

The first locking member 31 includes a first body 35 and three first engaging portions 311 disposed at the first body 35, and a pushing portion 312 disposed at the first body 35. In this embodiment, the first body 35 is vertical and elongate, and includes a base wall 351 disposed behind and adjacent to the panel 13, a plurality of transverse walls 352 extending forwardly from the base wall 351, two vertical walls 353 extending respectively and forwardly from left and right sides of the base wall 351, and a plurality of guiding plates 354 extending respectively and perpendicularly from the vertical walls 353 and arranged in two rows. Any two adjacent guiding plates 354 in each row define cooperatively a notch 350. The base wall 351 has a forward surface 356 (see FIG. 5).

The first body 35 is movable vertically on the door base 1. In this embodiment, the first body 35 is connected movably to the back surface 133 of the panel 13, in such a manner to engage the guiding plates 354 with the guiding grooves 154 in the guiding blocks 151, respectively. The function of the notches 350 in the first body 35 now will be described. When it is desired to mount the first body 35 to the back surface 133 of the panel 13, the first body 35 is first moved to a position disposed behind the back surface 133 of the panel 13 and permitting the forward surface 356 to face the back surface 133 of the panel 13 and permitting the notches 350 to align with the guiding blocks 151, respectively. Next, the first body 35 is moved forwardly to allow the guiding blocks 151 to pass through the notches 350, respectively. Subsequently, the guiding plates 354 are engaged respectively into the guiding grooves 154, thereby completing assembly of the first body 35 and the panel 13.

In this embodiment, the door base 1 further includes a guiding rod 16 extending rearwardly from the back surface 133 of the panel 13. The base wall 351 of the first body 35 further includes a vertical slide slot 355. The guiding rod 16 extends movably through the slide slot 355.

With particular reference to FIGS. 4 and 5, the first engaging portions 311 are disposed respectively at the transverse walls 352 of the first body 35. In this embodiment, each of the first engaging portions 311 includes a post 311*a* extending upwardly from the corresponding transverse wall 352, and a first inclined guiding surface 315 disposed at an upper end portion of said post 311*a*, facing upwardly, and extending rearwardly and upwardly toward the base wall 351. In this embodiment, the base wall 351 further includes three through holes 358 that are formed therethrough and that are arranged one above another. The first engaging portions 311 extend respectively into the through holes 358. Each of the second locking members 32 includes a second body 321 configured as a plate and extending rearwardly from the door 2, and a second inclined guiding surface 323 disposed at the second body 321 (see FIG. 8), facing downwardly, and inclined upwardly and rearwardly. The pushing portion 312 includes a projection 312*a* extending from the forward surface 356 of the base wall 351, and a third inclined guiding surface 313 disposed at the projection 312*a*. The projection 312*a* extends into the middle through hole 358. The third inclined guiding surface 313 faces downwardly, and is inclined upwardly and forwardly. The pushing portion 312 is disposed in proximity to, behind, and above the middle first engaging portion 311. As such, the pushing portion 312 is farther away from the panel 13 than the middle first engaging portion 311.

The resilient member 34 is configured as a tension spring, and has two opposite ends connected respectively to the panel 13 and the first body 35. When the first body 35 is moved downwardly relative to the panel 13, the resilient member 34 is stretched to store a return force biasing the first body 35 to move in a first direction (i.e., upward direction). In this embodiment, the resilient member 34 is connected to the guiding rod 16 at an upper end thereof, and to a portion of the base wall 351 adjacent to a bottom end of the slide slot 355 at a lower end thereof.

With particular to FIGS. 2 and 5, the second locking members 32 are spaced apart from each other along a vertical direction, and are aligned respectively with the first engaging portions 311 of the first locking member 31. Each of the second locking members 32 further includes a second engaging portion 322 formed vertically through the second body 321.

Figure 6:
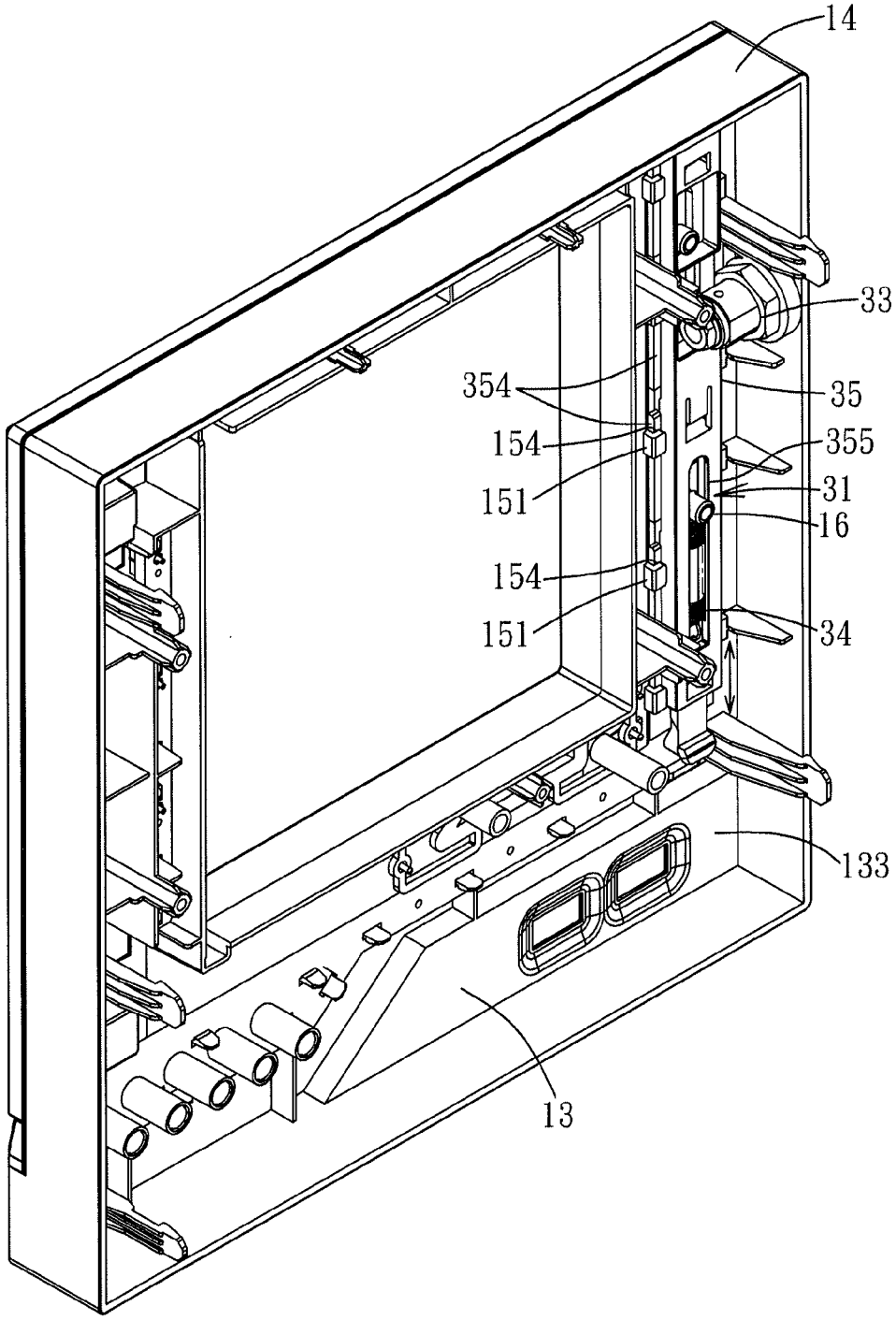
FIG. 6 is a fragmentary rear perspective view of the embodiment, illustrating how the first locking member is connected to a door base.

With particular reference to FIGS. 5 and 6, the lock 33 is disposed on the surrounding plate 14 of the door base 1, is adjacent to the first locking member 31, and has a projecting plate 331. The projecting plate 331 is in contact with the first body 35 due to the biasing action of the resilient member 34, and is rotatable to push and move the first body 35 downwardly. In this embodiment, the first body 35 is formed with an opening 357 (see FIG. 4) permitting the projecting plate 331 to extend thereinto and abut against a wall defining the opening 357.

With particular reference to FIGS. 1 and 5, when the door 2 is covered on the front surface 132 of the panel 13 of the door base 1, the second bodies 321 extend respectively through the holes 131 in the panel 13, and the first engaging portions 311 extend respectively into the second engaging portions 322 in the first direction, so as to lock the door 2 at a locked position.

Figure 7:
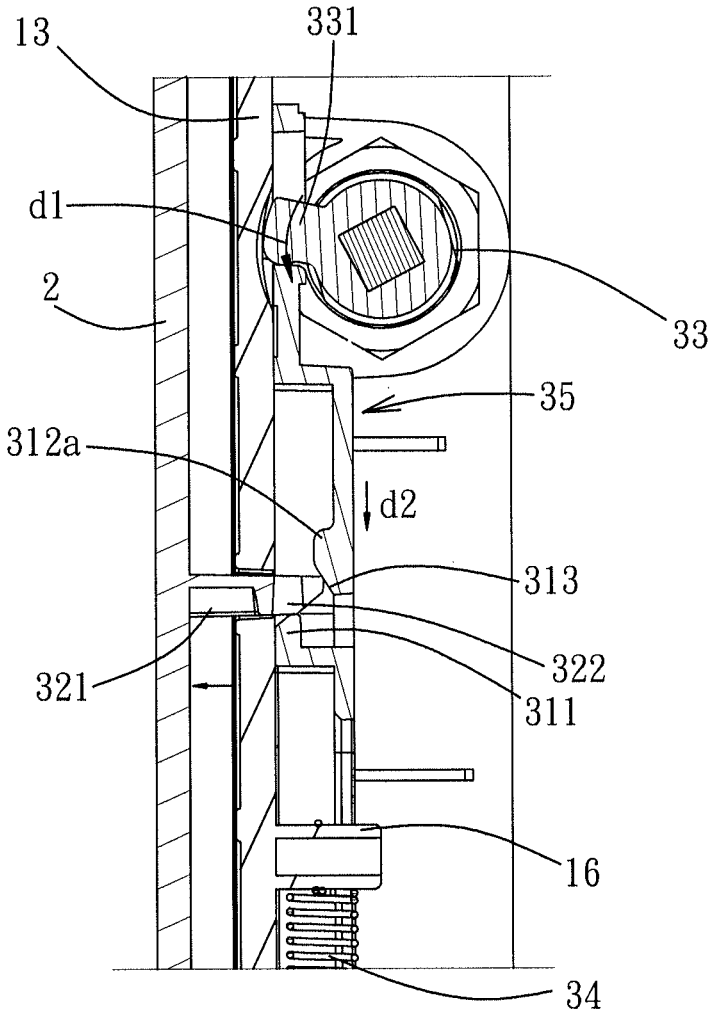
FIGS. 7, 8, and 9 are fragmentary sectional views of the embodiment, illustrating how a door is automatically pushed open when unlocked and how a lock is biased to return to its original position after a force for unlocking the door is released.
Figure 8:
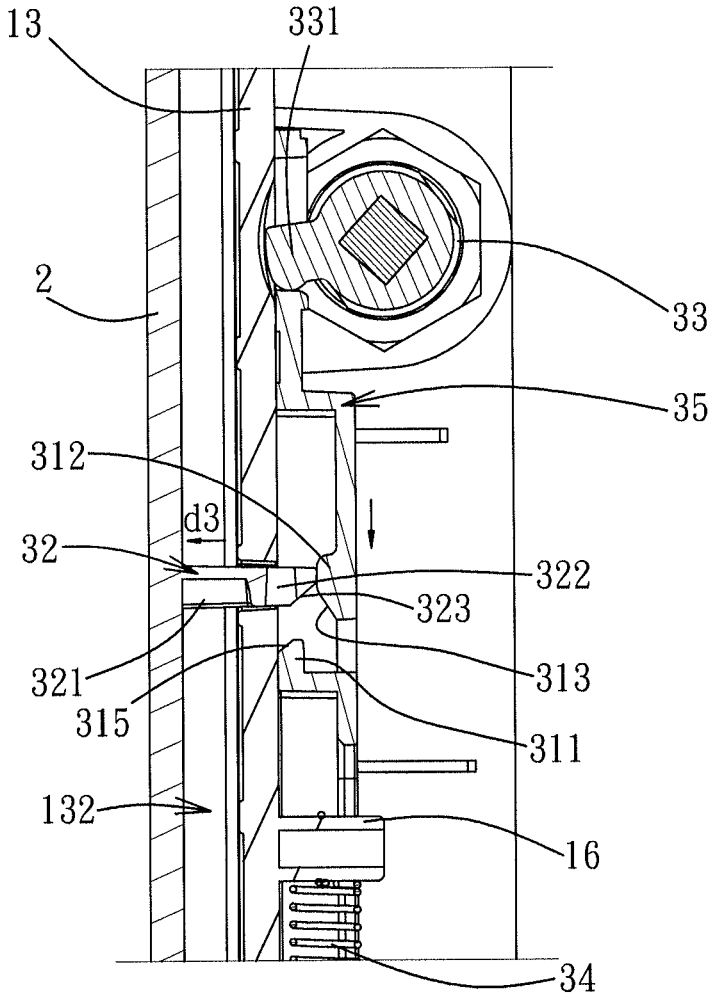

With particular reference to FIG. 7, when opening of the door 2 is desired, a key is inserted into the lock 33. Subsequently, a force is applied to rotate the key to thereby pivot the projecting plate 331 downwardly in a counterclockwise direction d1 so as to move the first body 35 in a second direction (i.e., downward direction) d2. During downward movement of the first body 35, the first engaging portions 311 are first removed respectively from the second engaging portions 322. Next, the third inclined guiding surface 313 of the pushing portion 312 comes into contact with the middle second engaging portion 321. Hence, the middle second engaging portion 321 is pushed by the third inclined guiding surface 313 to separate from the panel 13 in a forward direction d3 until the second inclined guiding surfaces 323 are aligned respectively with, disposed respectively above, and are spaced apart from the first inclined guiding surfaces 315 of the first engaging portions 311, as shown in FIG. 8. At the same time, the resilient member 34 is stretched.

Figure 9:
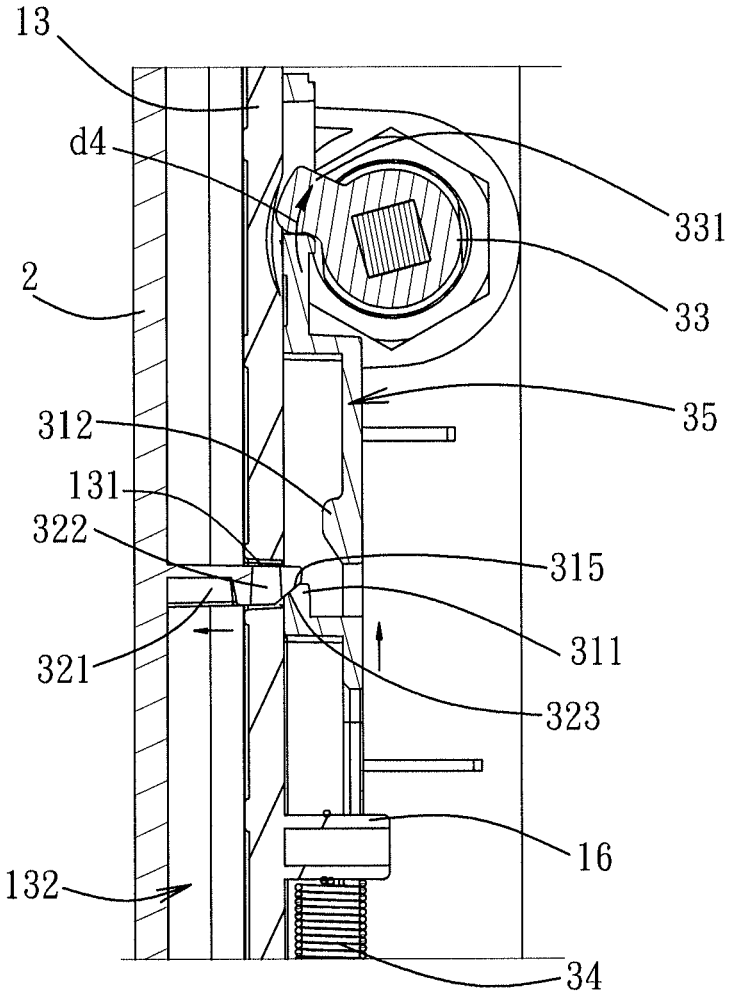
Figure 10:
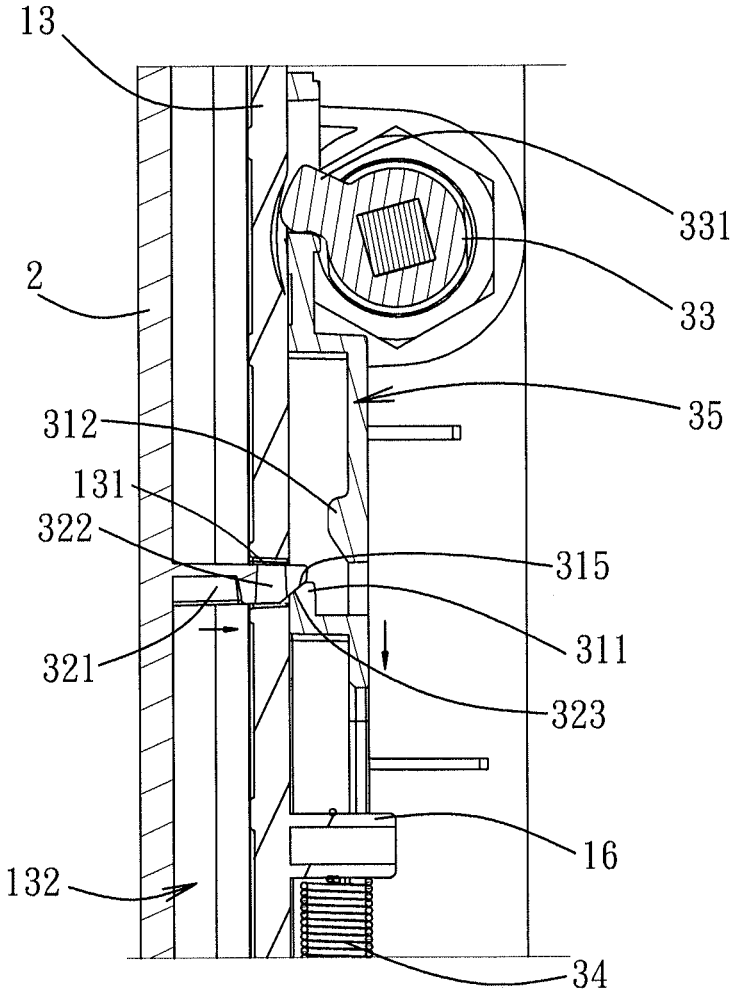
FIG. 10 is a fragmentary sectional view of the embodiment, illustrating that the door is pushed to pivot toward the door base.

Referring to FIG. 9, when the force is released, due to the return force of the resilient member 34, the first body 35 is biased to move upwardly. During upward movement of the first body 35, the first inclined guiding surfaces 315 come into contact with the second inclined guiding surfaces 323, respectively. Hence, the second bodies 321 are pushed by the first inclined guiding surfaces 315 to further move forwardly away from the panel 13, thereby ensuring separation of the door 2 from the door base 1 when the door 2 is unlocked.

Also during upward movement of the first body 345, the first body 35 comes into contact with the projecting plate 331 of the lock 33. Hence, the projecting plate 331 is pushed by the first body 35 to pivot in a clockwise direction d4 to thereby return to its original position whereat no external force is applied to the key and, thus, the lock 33.

Conversely, when it is desired to close the door 2, the door 2 is pivoted rearwardly toward the front surface 132 of the panel 13. During rearward pivoting movement of the door 2, the second bodies 321 of the door 2 are inserted respectively through the holes 131 in the panel 13, so that the second inclined guiding surfaces 323 come into contact with the first inclined guiding surfaces 315, respectively. Hence, the first body 35 is pushed by the second inclined guiding surfaces 323 to move downwardly to thereby stretch the resilient member 34. During sliding movement of the second inclined guiding surfaces 323 over the first inclined guiding surfaces 315, as soon as the second engaging portions 322 are aligned respectively with the first engaging portions 311, the first engaging portions 311 are biased by the resilient member 34 to move upward to engage the second engaging portions 322, thereby locking the door at the locked position.

As such, through cooperation among the pushing portion 312, the first, second, and third inclined guiding surfaces 315, 323, 313, and the resilient member 34, after the first engaging portions 311 are disengaged respectively from the second engaging portions 322, the door 2 is automatically pushed open, and the lock 33 is biased to return to its original position. In addition, through cooperation of the first inclined guiding surfaces 315 with the second inclined guiding surfaces 323, when the door 2 is covered on the door base 1, the first engaging portions 311 can engage the second engaging portions 322 without operating the lock 33.

In view of the above, through operation of the first and second locking members 31, 32 and the lock 33, the first locking member 31 can be locked on or unlocked from the second locking members 32 in such a manner that, when the first locking member 31 is unlocked from the second locking members 32, the door 2 is automatically pushed open, which can be realized by the user. Furthermore, when a force for rotating the lock 33 is released, the lock 33 is pivoted by the first locking member 31 to its original position without additional operation of the user. Thus, the objects of this invention are achieved.

Further, due to design of the first inclined guiding surfaces 315 and/or the second inclined guiding surfaces 323, the first locking member 31 can be locked automatically on the second locking members 32 without operating the lock 33, thereby resulting in convenience during use of the door assembly 100.

With this invention thus explained, it is apparent that numerous modifications and variations can be made without departing from the scope and spirit of this invention. It is therefore intended that this invention be limited only as indicated by the appended claims.

We claim:

1. A door assembly comprising:

a door base;

a door disposed pivotally on said door base for covering openably said door base; and a locking mechanism including a first locking member including a first body disposed movably on said door base and biased to move relative to said door base in a first direction, a first engaging portion disposed at said first body and extending along the first direction, and a pushing portion disposed at said first body, a second locking member including a second body disposed on said door, and a second engaging portion disposed at said second body and engaging said first engaging portion along the first direction, and a lock disposed on said door base and operable to move said first body relative to said door base in a second direction opposite to the first direction;

wherein said first engaging portion is biased to move in the first direction to thereby engage said second engaging portion, so as to lock said door at a locked position for covering said door base; and when said lock is operated to move said first body in the second direction, said first engaging portion is removed from said second engaging portion, and said second body is pushed by said pushing portion to separate from said door base.

2. The door assembly as claimed in claim 1, wherein said locking mechanism further includes a resilient member disposed between said door base and said first body for biasing said first body to move relative to said door base in the first direction.

3. The door assembly as claimed in claim 2, wherein said door base includes a panel having a front surface facing said door, and a back surface, said first body including a base wall disposed behind and adjacent to said panel, and a transverse wall extending from said base wall toward said panel, said first engaging portion being disposed at said transverse wall, said pushing portion being disposed above said first engaging portion and extending from said base wall toward said panel.

4. The door assembly as claimed in claim 3, wherein said first engaging portion includes a post extending upwardly from said transverse wall, and said second engaging portion is configured as a hole.

5. The door assembly as claimed in claim 4, wherein said first engaging portion further includes a first inclined guiding surface disposed at said post and inclined relative to the first direction such that, when said door is pivoted toward said door base, said second body comes into contact with said first inclined guiding surface to thereby push said post and, thus, said first body to move relative to said door base in the first direction.

6. The door assembly as claimed in claim 5, wherein said second locking member further includes a second inclined guiding surface disposed at said second body and facing said first inclined guiding surface such that, when said door is moved toward said door base, said second inclined guiding surface slides over said first inclined guiding surface so that said first body is pushed by said second body to move relative to said door base in the second direction.

7. The door assembly as claimed in claim 3, wherein said base wall has a forward surface facing said panel, and said pushing portion includes a projection extending from said forward surface.

8. The door assembly as claimed in claim 7, wherein said pushing portion further includes a third inclined guiding surface disposed at said projection and positioned such that, when said first body is moved in the second direction by said lock, said second body is pushed by said third inclined guiding surface to move away from said door base.

9. The door assembly as claimed in claim 3, wherein said door base further includes a guiding structure disposed at said back surface of said panel for guiding movement of said first body relative to said panel in the first direction, said panel being formed with a hole permitting extension of said second body therethrough.

10. The door assembly as claimed in claim 9, wherein said guiding structure includes a plurality of guiding blocks, said hole being disposed between two adjacent ones of said guiding blocks, each of said guiding blocks cooperating with said back surface of said panel to define a guiding groove, said first body further including a plurality of vertical walls extending from said base wall toward said back surface of said panel, and a plurality of guiding plates extending respectively and perpendicularly from said vertical walls, arranged in two rows, and engaging respectively and movably said guiding grooves defined by said guiding blocks.

11. The door assembly as claimed in claim 10, wherein any two adjacent ones of said guiding plates in each of said two rows define cooperatively a notch that is aligned with a respective one of said guiding blocks.

12. The door assembly as claimed in claim 10, wherein each of said guiding blocks includes a first flat plate portion extending from said back surface of said panel, and a second flat plate portion extending perpendicularly from an end of said first flat plate portion and spaced apart from said back surface of said panel.

13. The door assembly as claimed in claim 9, wherein said door base further includes a guiding rod extending rearwardly from said back surface of said panel, said base wall of said first body further including a vertical slide slot, said guiding rod extending movably through said slide slot, said resilient member having two opposite ends connected respectively to said guiding rod and a portion of said base wall adjacent to a bottom end of said slide slot.

14. The door assembly as claimed in claim 2, wherein said lock has a projecting plate in contact with said first body for pushing said first body when a force is applied to rotate said lock relative to said door base, said projecting plate being biased to its original position when the force is released.

15. A casing comprising:

a housing; and a door assembly including a door base, a door disposed pivotally on said door base for covering openably said door base, and a locking mechanism including a first locking member including a first body disposed movably on said door base and biased to move relative to said door base in a first direction, a first engaging portion disposed at said first body, and a pushing portion disposed at said first body, a second locking member including a second body disposed on said door, and a second engaging portion disposed at said second body, and a lock disposed on said door base and operable to move said first body relative to said door base in a second direction opposite to the first direction;

wherein said first engaging portion is biased to move in the first direction to thereby engage said second engaging portion, so as to lock said door at a locked position for covering said door base; and when said lock is operated to move said first body in the second direction, said first engaging portion is removed from said second engaging portion, and said second body is pushed by said pushing portion to separate from said door base.

16. The casing as claimed in claim 15, wherein said locking mechanism further includes a resilient member disposed between said door base and said first body for biasing said first body to move relative to said door base in the first direction.

17. The casing as claimed in claim 16, wherein said door base includes a panel having a front surface facing said door, and a back surface, said first body including a base wall disposed behind and adjacent to said panel, and a transverse wall extending from said base wall toward said panel, said first engaging portion being disposed at said transverse wall, said pushing portion being disposed above said first engaging portion and extending from said base wall toward said panel.

18. The casing as claimed in claim 17, wherein said first engaging portion includes a post extending upwardly from said transverse wall, and said second engaging portion is configured as a hole.

19. The casing as claimed in claim 18, wherein said first engaging portion further includes a first inclined guiding surface disposed at said post and inclined relative to the first direction such that, when said door is pivoted toward said door base, said second body comes into contact with said first inclined guiding surface to thereby push said post and, thus, said first body to move relative to said door base in the first direction.

20. The casing as claimed in claim 19, wherein said second locking member further includes a second inclined guiding surface disposed at said second body and facing said first inclined guiding surface such that, when said door is moved toward said door base, said second inclined guiding surface slides over said first inclined guiding surface so that said first body is pushed by said second body to move relative to said door base in the second direction.

21. The casing as claimed in claim 17, wherein said base wall has a forward surface facing said panel, and said pushing portion includes a projection extending from said forward surface.

22. The casing as claimed in claim 21, wherein said pushing portion further includes a third inclined guiding surface disposed at said projection and positioned such that, when said first body is moved in the second direction by said lock, said second body is pushed by said third inclined guiding surface to move away from said door base.

23. The casing as claimed in claim 17, wherein said door base further includes a guiding structure disposed at said back surface of said panel for guiding movement of said first body relative to said panel in the first direction, said panel being formed with a hole permitting extension of said second body therethrough.

24. The casing as claimed in claim 23, wherein said guiding structure includes a plurality of guiding blocks, said hole being disposed between two adjacent ones of said guiding blocks, each of said guiding blocks cooperating with said back surface of said panel to define a guiding groove, said first body further including a plurality of vertical walls extending from said base wall toward said back surface of said panel, and a plurality of guiding plates extending respectively and perpendicularly from said vertical walls, arranged in two rows, and engaging respectively and movably said guiding grooves defined by said guiding blocks.

25. The casing as claimed in claim 24, wherein any two adjacent ones of said guiding plates in each of said two rows define cooperatively a notch that is aligned with a respective one of said guiding blocks.

26. The casing as claimed in claim 24, wherein each of said guiding blocks includes a first flat plate portion extending from said back surface of said panel, and a second flat plate portion extending perpendicularly from an end of said first flat plate portion and spaced apart from said back surface of said panel.

27. The casing as claimed in claim 23, wherein said door base further includes a guiding rod extending rearwardly from said back surface of said panel, said base wall of said first body further including a vertical slide slot, said guiding rod extending movably through said slide slot, said resilient member having two opposite ends connected respectively to said guiding rod and a portion of said base wall adjacent to a bottom end of said slide slot.

28. The casing as claimed in claim 16, wherein said lock has a projecting plate in contact with said first body for pushing said first body when a force is applied to rotate said lock relative to said door base, said projecting plate being biased to its original position when the force is released.

* * * * *